US009709914B2

(12) United States Patent
Inaba et al.

(10) Patent No.: US 9,709,914 B2
(45) Date of Patent: Jul. 18, 2017

(54) LIQUID DEVELOPER, DEVELOPER CARTRIDGE, AND IMAGE FORMING APPARATUS

(71) Applicant: FUJI XEROX CO., LTD., Tokyo (JP)

(72) Inventors: Yoshihiro Inaba, Kanagawa (JP); Takako Kobayashi, Kanagawa (JP); Daisuke Yoshino, Kanagawa (JP); Akira Imai, Kanagawa (JP); Masahiro Oki, Kanagawa (JP); Koji Horiba, Kanagawa (JP); Hiroyuki Moriya, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/824,358

(22) Filed: Aug. 12, 2015

(65) Prior Publication Data

US 2016/0231663 A1 Aug. 11, 2016

(30) Foreign Application Priority Data

Feb. 5, 2015 (JP) ..... 2015-020809

(51) Int. Cl.

| | |
|---|---|
| ***G03G 9/125*** | (2006.01) |
| ***G03G 9/13*** | (2006.01) |
| ***G03G 9/087*** | (2006.01) |

(52) U.S. Cl.

CPC ..... *G03G 9/131* (2013.01); *G03G 9/08766* (2013.01); *G03G 9/08773* (2013.01); *G03G 9/125* (2013.01)

(58) Field of Classification Search

CPC .... G03G 9/125; G03G 9/131; G03G 9/08766; G03G 9/08773

See application file for complete search history.

(56) References Cited

U.S. PATENT DOCUMENTS

| | | | |
|---|---|---|---|
| 2004/0241567 | A1 | 12/2004 | Teraoka et al. |
| 2010/0003054 | A1 | 1/2010 | Ueno et al. |
| 2010/0014894 | A1 | 1/2010 | Ueno et al. |
| 2010/0015546 | A1 | 1/2010 | Oki et al. |

FOREIGN PATENT DOCUMENTS

| | | | |
|---|---|---|---|
| JP | 2014-038220 | * | 2/2014 |

OTHER PUBLICATIONS

Machine translation of JP2014-038220.*

* cited by examiner

*Primary Examiner* — Thorl Chea
(74) *Attorney, Agent, or Firm* — Oliff PLC

(57) ABSTRACT

A liquid developer includes a carrier liquid and a toner particle whose surface is treated by a polyamine, wherein an amount of sodium ion to be eluted in 1 g of the toner particles is 0.04 mg or less.

12 Claims, 1 Drawing Sheet

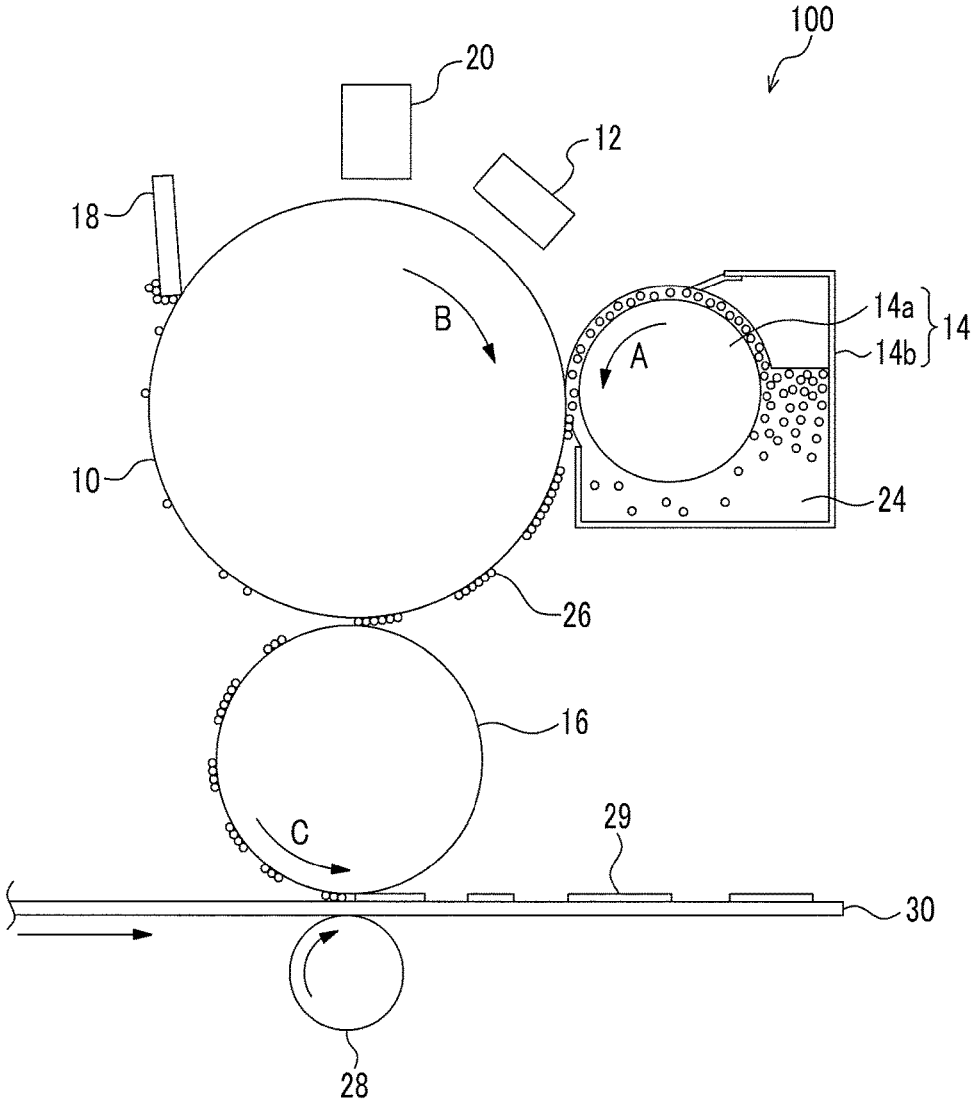
100
20
12
18
B
A
14a
14
14b
10
24
26
16
C
29
30
28

LIQUID DEVELOPER, DEVELOPER CARTRIDGE, AND IMAGE FORMING APPARATUS

CROSS-REFERENCE TO RELATED APPLICATIONS

This application is based on and claims priority under 35 USC 119 from Japanese Patent Application No. 2015-020809 filed Feb. 5, 2015.

BACKGROUND

1. Technical Field

The present invention relates to a liquid developer, a developer cartridge, and an image forming apparatus.

2. Related Art

A method of visualizing image information though an electrostatic charge image, such as an electrophotography method, is currently used in many fields. In the electrophotography method, a latent image (electrostatic latent image) is formed on an image holding member in charging and exposing processes (latent image forming process), and the latent image is visualized by developing an electrostatic latent image with a developer for developing an electrostatic charge image (hereinafter, also simply referred to as a "developer") including a toner for developing an electrostatic charge image (hereinafter, also simply referred to as a "toner") (developing process), and performing a transfer process and a fixing process. As a developer used in a dry development method, a two-component developer containing a toner and a carrier, and a single component developer in which a magnetic toner or a non-magnetic toner is singly used are included.

Meanwhile, a liquid developer used in a wet development method is obtained by dispersing toner particles in an insulating carrier liquid. A type in which toner particles including a thermoplastic resin are dispersed in a volatile carrier liquid, a type in which toner particles including a thermoplastic resin are dispersed in a hardly volatile carrier liquid, and the like are known.

SUMMARY

According to an aspect of the invention, there is provided a liquid developer including:

a carrier liquid; and a toner particle whose surface is treated by a polyamine, wherein an amount of sodium ions to be eluted in 1 g of the toner particles is 0.04 mg or less.

BRIEF DESCRIPTION OF THE DRAWING

Exemplary embodiments of the present invention will be described in detail based on the following FIGURE, wherein:

The Figure is a configuration view schematically illustrating an example of an image forming apparatus according to an exemplary embodiment.

DETAILED DESCRIPTION

Exemplary embodiments of the invention are described below. The exemplary embodiments are provided as examples implementing the invention, and the invention is not limited thereto.

Liquid Developer

The liquid developer according to the exemplary embodiment contains a carrier liquid and a toner particle whose surface is treated by a polyamine and which contain a styrene acrylic resin, and the amount of sodium ions to be eluted in 1 g of the toner particles is 0.04 mg or less.

A liquid developer obtained by dispersing toner particles containing a polyester resin and a styrene acrylic resin as a binder resin in a carrier liquid has been studied, but it is difficult to positively charge a liquid developer in a carrier liquid, particularly, silicone oil because these resins are materials which have a tendency to be basically negatively charged. According to the exemplary embodiment, in a liquid developer obtained by dispersing toner particles which contain a binder resin such as a polyester resin or a styrene acrylic resin in a carrier liquid, a liquid developer having excellent positive charging properties is realized by adjusting the amount of sodium ions to be eluted in 1 g of the toner particles to be 0.04 mg or less using toner particles whose surface is treated by a polyamine as the toner particles.

The present inventors have proposed that a liquid developer having excellent positive charging properties may be obtained even in a case where silicone oil is used as a carrier liquid when the liquid developer contains a toner particle whose surface is treated by a polyamine and a carboxyl group-containing silicone. However, unevenness in positive charging properties is generated due to a toner in some cases. During investigation for the cause, the present inventors have found that the positive charging properties are affected by sodium ions in toner particles when the toner particles are surface-treated by a polyamine. Further, the present inventors have found that the positive charging properties are improved by adjusting the amount of sodium ions to be eluted in 1 g of the toner particles to be 0.04 mg or less.

It is considered that the sodium ions contained in toner particles are sodium ions derived from a binder resin or sodium ions derived from a base or a surfactant used at the time of preparation of toner particles. By adjusting the amount of these sodium ions in toner particles to be less than or equal to a regulated amount, stabilized positive charging properties may be obtained. For example, in a process of performing surface modification of toner particles, the amount of sodium ions to be eluted in 1 g of the toner particles may be adjusted to be 0.04 mg or less by adjusting the pH of a dispersion of the toner particles to be less than 2 and preferably less than or equal to 1.5, adding a polyamine thereto, stirring and then performing solid-liquid separation, and performing washing with water and solid-liquid separation until the conductivity of the washing solution becomes less than or equal to a predetermined value.

The amount of sodium ions to be eluted in 1 g of the toner particles in the liquid developer according to the exemplary embodiment is 0.04 mg or less, preferably 0.03 mg or less, and more preferably 0.02 mg or less.

A method of determining the amount of sodium ions to be eluted in 1 g of the toner particles is as follows.

The amount thereof is determined by eluting sodium ions existing in the vicinity of the surface of toner particles in an aqueous dispersion medium using ion chromatography. Since the amount of sodium ions to be eluted from the toner particles varies depending on the elution conditions, a liquid extracted for 30 minutes through ultrasonic dispersion at 28 Hz and at a temperature of 30° C. is used as an analytical sample for ion chromatography.

Preparation of Analytical Sample for Ion Chromatography (Pre-Treatment)

1.0 g of toner particles are mixed and dispersed in 200 mL of a 0.1 wt % solution of a non-ionic surfactant (NOIGEN EA-137, manufactured by Dai-ichi Kogyo Seiyaku Co., Ltd.) and extraction is performed for 30 minutes using an ultrasonic disperser (USD-4R, manufactured by AS ONE Corporation) whose temperature is adjusted to be 30±1.0° C. in a thermostatic bath. With respect to the dispersion treated using ultrasonic waves, toner particles are separated using a syringe filter (HP020AN, manufactured by Advantech Co., Ltd.) washed with ultrapure water in advance, and the resultant filtrate is used as a sample for ion chromatography analysis.

Ion Chromatography Analysis

Ion chromatography analysis is performed using a 20 mM methane sulfonic acid solution as an eluent for analysis under the analysis condition of a temperature of 30° C. and a flow rate of 1 mL/min with an ion chromatograph device (ICS-2000, manufactured by Nippon Dionex K.K.). The eluted ions are identified from the elution time determined using a standard solution (Na+) prepared separately. Further, the amount of sodium ions is determined based on a calibration curve created separately using the standard solution. The amount of ions is expressed by the concentration (mg/L) in a measurement sample, but the amount (mg) of sodium ions to be eluted from 1 g of the toner particles is obtained by multiplying the value by ⅕.

Hereinafter, constituent components of the liquid developer according to the exemplary embodiment will be described in detail.

Toner Particles

Toner particles contained in the liquid developer according to the exemplary embodiment contains a binder resin and may contain other components such as a colorant and a release agent if necessary. The surface of the toner particle is treated by a polyamine. The positive charging properties are provided for the liquid developer by using the toner particles whose surface is treated by a polyamine.

Examples of the polyamine include polyalkyleneimines, polyallylamines, and polydiallylamines. Among these, polyalkyleneimines and polyallylamines are preferable in terms that polyalkyleneimines and polyallylamines are highly cationic and easily positively charged.

As the polyalkyleneimines, polyethyleneimine is exemplified.

As the polyallylamines, a polyallylamine represented by the formula (I) is exemplified.

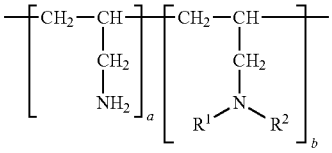

(I)

(In the formula (I), $R^1$ and $R^2$ each independently represent a hydrogen atom or an aliphatic hydrocarbon group having 1 to 20 carbon atoms and a and b each independently represent an integer of 100 to 1,000.)

$R^1$ and $R^2$ each independently represent a hydrogen atom or an aliphatic hydrocarbon group having 1 to 20 carbon atoms, preferably an aliphatic hydrocarbon group having 1 to 20 carbon atoms. Examples of the aliphatic hydrocarbon group having 1 to 20 carbon atoms include a methyl group, an ethyl group, a linear or branched propyl group, a butyl group, a pentyl group, a hexyl group, and an octyl group. Among these, a methyl group is preferable.

a and b each independently represent an integer of 1 to 10,000 and an integer of 5 to 1,000 is preferable.

The amount of the polyamine with respect to the toner particles is preferably in the range of 0.01 parts by weight to 100 parts by weight, more preferably in the range of 0.1 parts by weight to 100 parts by weight, and most preferably in the range of 0.1 parts by weight to 10 parts by weight with respect to 100 parts by weight of the toner particles. When the amount of the polyamine with respect to the toner particles is less than 0.01 parts by weight with respect to 100 parts by weight of the toner particles, charging properties may be deteriorated. When the amount thereof exceeds 100 parts by weight, the conductivity of the developer is extremely high and this may lead to deterioration of charging properties.

The weight average molecular weight of the polyamine is preferably in the range of 100 to 1,000,000 and more preferably in the range of 1,000 to 100,000. When the weight average molecular weight of the polyamine is less than 100, adsorptive properties to the surface of the toner is deteriorated and thus target charging performance may not be obtained. When the weight average molecular weight exceeds 1,000,000, the toner particles may be adhered to each other.

Crystalline Polyester Resin

It is preferable that the toner according to the exemplary embodiment contains a crystalline resin and an amorphous resin as a binder resin. In the exemplary embodiment, the "crystalline" of the "crystalline resin" means that the resin has a clear endothermic peak without a stepwise endothermic change in differential scanning calorimetry (DSC) of a resin. Specifically, in differential scanning calorimetry (DSC) using a differential scanning calorimeter (device name: DSC-60 type, manufactured by Shimadzu Corporation) which has an automatic tangent line processing system, it may be said that a "clear" endothermic peak exists when the temperature from an onset point to the peak top of the endothermic peak is within 10° C. when the temperature is increased at a temperature rising rate of 10° C./min. A point of a flat portion of a base line in the DSC curve and a point of a flat portion of a falling portion from the base line are designated, and the intersection of a tangent line of the flat portions between both points is determined as an "onset point" by the automatic tangent line processing system. Meanwhile, a resin in which a stepwise endothermic change is recognized without a clear endothermic peak means an "amorphous resin" and is a resin which is a solid at room temperature and thermoplasticized at a temperature higher than or equal to the glass transition temperature. Further, the "amorphous resin" does not show an endothermic peak corresponding to a crystalline melting temperature other than the stepwise endothermic point corresponding to glass transition in the differential scanning calorimetry (DSC).

As a polymerizable monomer component constituting a crystalline polyester resin, a polymerizable monomer including a linear aliphatic component is preferable rather than a polymerizable monomer including an aromatic component in terms of easily forming a crystal structure. In order not to deteriorate crystallinity, it is preferable that two or more kinds of the components derived from two or more kinds of polymerizable monomers each are present in an amount of 30% by mole or greater in a polymer. A crystalline polyester resin is configured of two or more kinds of polymerizable monomers, but it is preferable that respective polymerizable monomers have the above-described configurations.

The melting temperature of the crystalline polyester resin is preferably in the range of 50° C. to 100° C., more preferably in the range of 55° C. to 90° C., and still more preferably in the range of 60° C. to 85° C. When the melting temperature is lower than 50° C., there may be a problem with toner storage properties, for example, occurrence of blocking in a stored toner or storage properties of a fixed image after fixation. Further, when the melting temperature exceeds 100° C., low temperature fixing properties may not be sufficiently obtained. In addition, the melting temperature of the above-described crystalline polyester resin is determined as a peak temperature of the endothermic peak obtained through the above-described differential scanning calorimetry (DSC).

The "crystalline polyester resin" according to the exemplary embodiment also means a polymer (copolymer) obtained by polymerizing a component constituting polyester and another component as well as a polymer whose constituent component has a 100% polyester structure. However, in the former case, the content of the constituent component other than the component constituting polyester is 50% by weight or less.

The crystalline polyester resin is synthesized from a polyvalent carboxylic acid component and a polyol component. In addition, in the exemplary embodiment, a commercially available product or a synthesized product may be used as the crystalline polyester resin.

Examples of the polyvalent carboxylic acid component include aliphatic dicarboxylic acid such as oxalic acid, succinic acid, glutaric acid, adipic acid, suberic acid, azelaic acid, sebacic acid, 1,9-nonanedicarboxylic acid, 1,10-decanedicarboxylic acid, 1,12-dodecanedicarboxylic acid, 1,14-tetradecanedicarboxylic acid, or 1,18-octadecanedicarboxylic acid; and aromatic dicarboxylic acid, for example, a dibasic acid such as phthalic acid, isophthalic acid, terephthalic acid, naphthalene-2,6-dicarboxylic acid, malonic acid, or mesaconic acid. In addition, an anhydride thereof and a lower alkyl ester thereof are also exemplified, but the examples are not limited thereto.

Examples of the tri- or higher valent carboxylic acid include 1,2,4-benzenetricarboxylic acid, 1,2,5-benzenetricarboxylic acid, 1,2,4-naphthalenetricarboxylic acid, and an anhydride thereof or a lower alkyl ester thereof. There may be used alone or in combination of two or more kinds thereof.

Further, a dicarboxylic acid component having a sulfonic acid group may be contained as a polyvalent carboxylic acid component in addition to the above-described aliphatic dicarboxylic acid or aromatic dicarboxylic acid. In addition, a dicarboxylic acid component having a double bond may be contained in addition to the above-described aliphatic dicarboxylic acid or aromatic dicarboxylic acid as the polyvalent carboxylic acid component.

As the polyol component, an aliphatic diol is preferable and a linear aliphatic diol whose main chain portion has 7 to 20 carbon atoms is more preferable. When the aliphatic diol is branched, the crystallinity of a polyester resin may be deteriorated so that the melting temperature is decreased. In addition, when the number of carbon atoms in the main chain portion thereof is less than 7, the melting temperature becomes increased and low temperature fixation may become difficult in a case of polycondensation with aromatic dicarboxylic acid. Meanwhile, when the number of carbon atoms in the main chain portion thereof exceeds 20, it becomes difficult to obtain the material practically. The number of carbon atoms in the main chain portion is more preferably 14 or less.

Specific examples of the aliphatic diol to be preferably used for synthesis of the crystalline polyester include ethylene glycol, 1,3-propanediol, 1,4-butanediol, 1,5-pentanediol, 1,6-hexanediol, 1,7-heptanediol, 1,8-octanediol, 1,9-nonanediol, 1,10-decanediol, 1,11-undecanediol, 1,12-dodecanediol, 1,13-tridecanediol, 1,14-tetradecanediol, 1,18-octadecanediol, and 1,14-eicosanedecanediol, but the examples are not limited thereto. Among these, in terms of availability, 1,8-octanediol, 1,9-nonanediol, and 1,10-decanediol are preferable.

Examples of the tri- or higher valent alcohol include glycerin, trimethylol ethane, trimethylol propane, and pentaerythritol. These may be used alone or in combination of two or more kinds thereof.

In the polyol components, the content of the aliphatic diol is preferably 80% by mole or greater and more preferably 90% by mole or greater. When the content of the aliphatic diol is less than 80% by mole, since the crystallinity of the polyester resin is deteriorated and the melting temperature thereof is decreased, toner blocking resistance, image stability, and low temperature fixing properties may be deteriorated.

Further, for the purpose of adjusting the acid value or the hydroxyl value if necessary, polyvalent carboxylic acid or polyol may be added at the final stage of synthesis. Examples of the polyvalent carboxylic acid include aromatic carboxylic acids such as terephthalic acid, isophthalic acid, phthalic anhydride, trimellitic anhydride, pyromellitic acid, and naphthalene dicarboxylic acid; aliphatic carboxylic acids such as maleic anhydride, fumaric acid, succinic acid, alkenyl succinic anhydride, and adipic acid; and alicyclic carboxylic acids such as cyclohexane dicarboxylic acid.

The crystalline polyester resin is prepared by, for example, setting the polymerization temperature to be in the range of 180° C. to 230° C., reducing the pressure in the inside of a reaction system if necessary, and carrying out a reaction while water or alcohol generated at the time of condensation is removed. In a case where a polymerizable monomer is not dissolved or compatible at the reaction temperature, a solvent having a high boiling point is added thereto, as a solubilizing agent, for dissolution of the polymerizable monomer. The polycondensation reaction may be carried out while the solubilizing agent is distilled. In a case where a polymerizable monomer with poor compatibility in the copolymerization reaction is present, the polymerizable monomer with poor compatibility and acid or alcohol to be polycondensed with the polymerizable monomer is condensed in advance and then may be polycondensed with the main component.

Examples of a catalyst to be used at the time of preparation of the polyester resin include an alkali metal compound such as sodium or lithium; an alkaline earth metal compound such as magnesium or calcium; a metal compound such as zinc, manganese, antimony, titanium, tin, zirconium, or germanium; a phosphorous acid compound; a phosphoric acid compound, and an amine compound.

The acid value of the crystalline polyester resin (mg number of KOH necessary for neutralizing 1 g of a resin) is preferably in the range of 3.0 mgKOH/g to 30.0 mgKOH/g, more preferably in the range of 6.0 mgKOH/g to 25.0 mgKOH/g, and still more preferably in the range of 8.0 mgKOH/g to 20.0 mgKOH/g.

Since the dispersibility in water is deteriorated when the acid value is less than 3.0 mgKOH/g, preparation of emulsified particles using a wet method may become difficult. Since stability as the emulsified particles at the time of aggregation is remarkably deteriorated, efficient preparation of a toner may become difficult. Meanwhile, when the acid value thereof exceeds 30.0 mgKOH/g, hygroscopicity as a toner is increased so that the toner may be environmentally easily affected.

The weight average molecular weight (Mw) of the crystalline polyester resin is preferably in the range of 6,000 to 35,000. When the weight average molecular weight (Mw) is less than 6,000, the toner soaks into the surface of a recording medium such as paper at the time of fixation and thus fixing unevenness is generated or the strength with respect to bending resistance of a fixed image is deteriorated in some cases. Further, when the weight average molecular weight (Mw) thereof exceeds 35,000, the viscosity at the time of melting is excessively increased and thus the temperature for reaching viscosity appropriate for fixation may be increased. As a result, the low temperature fixing properties may be deteriorated.

The weight average molecular weight is measured using gel permeation chromatography (GPC). When the molecular weight is measured using GPC, HLC-8120 (GPC•manufactured by TOSOH CORPORATION) is used as a measuring device, TSKGEL SUPER HM-M (15 cm) (column manufactured by TOSOH CORPORATION) is used, and measurement is performed with a THF solvent. In addition, the weight average molecular weight is calculated using a molecular weight calibration curve created by a monodispersed polystyrene standard sample from the measurement results.

The content of the crystalline polyester resin in the toner particles is preferably in the range of 3% by weight to 40% by weight, more preferably in the range of 4% by weight to 35% by weight, and still more preferably in the range of 5% by weight to 30% by weight. When the content of the crystalline polyester resin is less than 3% by weight, the low temperature fixing properties may not be sufficiently obtained. When the content thereof exceeds 40% by weight, toner strength or fixed image strength may not be sufficiently obtained and charging properties may be adversely affected.

It is preferable that a crystalline resin which contains the above-described crystalline polyester resin may include a crystalline polyester resin (hereinafter, also referred to as a "crystalline aliphatic polyester resin) synthesized using an aliphatic polymerizable monomer as a main component (50% by weight or greater). Further, in this case, the component ratio of the aliphatic polymerizable monomer constituting the above-described crystalline aliphatic polyester resin is preferably 60% by mole or greater and more preferably 90% by mole or greater. In addition, as the aliphatic polymerizable monomer, the aliphatic diols or the aliphatic dicarboxylic acids described above are preferably used.

Amorphous Polyester Resin

A known polyester resin may be used as the amorphous polyester resin. The amorphous polyester resin is synthesized from a polyvalent carboxylic acid component and a polyol component. In addition, as the amorphous polyester resin, a commercially available product may be used or a synthesized product may be used. Further, the amorphous polyester resin may be used alone or as a mixture of two or more kinds of polyester resins.

As the polyvalent carboxylic acid and the polyol used for the amorphous polyester resin, which are not particularly limited, monomer components described in "Polymer Data Handbook: Fundamentals" (edited by Society of Polymer, published by Baifukan Co., Ltd.) and known divalent or tri- or higher valent carboxylic acid and divalent or tri- or higher valent alcohol in the related art are exemplified.

Specific examples of these polymerizable monomer components include, as divalent carboxylic acid, dibasic acids such as succinic acid, alkyl succinic acid, alkenyl succinic acid, glutaric acid, adipic acid, suberic acid, azelaic acid, sebacic acid, phthalic acid, isophthalic acid, terephthalic acid, naphthalene-2,6-dicarboxylic acid, naphthalene-2,7-dicarboxylic acid, cyclohexane dicarboxylic acid, malonic acid, or mesaconic acid; anhydrides of these; lower alkyl ester of these; and aliphatic unsaturated dicarboxylic acid such as maleic acid, fumaric acid, itaconic acid, or citraconic acid. Among these compounds, it is preferable that 30% by mole or more of terephthalic acid be contained in acid components in terms of the balance between the glass transition temperature of the polyester resin and the flexibility of molecules.

Examples of tri- or higher valent carboxylic acid include 1,2,4-benzene tricarboxylic acid, 1,2,5-benzene tricarboxylic acid, 1,2,4-naphthalene tricarboxylic acid, anhydrides of these acids, and lower alkyl esters of these acids. These may be used alone or in combination of two or more kinds thereof.

Examples of the polyol include, as divalent alcohol, a bisphenol derivative such as hydrogenated bisphenol A, and ethylene oxide or a propylene oxide adduct of bisphenol A; cyclic aliphatic alcohol such as 1,4-cyclohexanediol or 1,4-cyclohexane dimethanol; a linear diol such as ethylene glycol, diethylene glycol, propylene glycol, dipropylene glycol, 1,4-butanediol, 1,5-pentanediol, or 1,6-hexanediol; and a branched diol such as 1,2-propanediol, 1,3-butanediol, neopentyl glycol, or 2,2-diethyl-1,3-propanediol, and an ethylene oxide or propylene oxide adduct of bisphenol A is preferably used from a viewpoint of the charging properties and the strength.

Further, examples of tri- or higher valent alcohol include glycerin, trimethylol ethane, trimethylol propane, and pentaerythritol, and the amount of trivalent or higher crosslinkable monomers used is preferably 10% by mole or less with respect to the total amount of monomers from a viewpoint of the low temperature fixing property or image gloss. These may be used alone or in combination of two or more kinds thereof. In addition, for the purpose of adjusting the acid value or the hydroxyl value according to the necessity, a monovalent acid such as acetic acid or benzoic acid or monovalent alcohol such as cyclohexanol or benzyl alcohol may be used.

Among these, in order to improve compatibility with a crystalline polyester resin, it is preferable that monomer components containing monomers, having a long-chain alkyl branch (the number of carbon atoms of the side chain: 4 or more) such as 1,2-hexanediol, alkyl succinic acid, alkenyl succinic acid, or anhydrides of these, in the range of 2% by mole to 30% by mole be used. Among these, it is preferable to contain alkyl succinic acid, alkenyl succinic acid, and anhydrides of these acids, which have high hydrophobicity.

As the amorphous polyester resin which is preferably used, a resin obtained through polycondensation between polyvalent carboxylic acids and polyols may be exemplified. Examples of the polyvalent carboxylic acid are the same as those exemplified for the above-described crystalline polyester resin.

Examples of the polyol in the amorphous polyester resin are the same as those exemplified for the above-described crystalline polyester resin.

The glass transition temperature (Tg) of the amorphous polyester resin is preferably in the range of 50° C. to 80° C. When Tg is lower than 50° C., problems in the storability of a toner or the storability of a fixed image are generated in some cases. When Tg is higher than 80° C., an image is not fixed at the lower temperature compared with that in the related art.

In addition, the amorphous polyester resin is prepared in conformity with the case of the crystalline polyester resin.

The softening temperature of a binder resin (flow tester ½ dropping temperature) is preferably in the range of 90° C. to 140° C., more preferably in the range of 100° C. to 135° C., and still more preferably in the range of 100° C. to 120° C. from a viewpoint of improving the fixing property of an image.

In addition, the binder resin is preferably soluble in tetrahydrofuran. Here, "soluble in tetrahydrofuran" means that the binder resin is dissolved in tetrahydrofuran when 1 g of the binder resin is added to 10 mL of tetrahydrofuran and dispersed in the tetrahydrofuran using an ultrasonic disperser at a temperature of 25° C. for 5 minutes.

As the binder resin, the toner particles according to the exemplary embodiment may include a styrene acrylic resin as a main component. The term "main component" indicates a component whose content is 50 parts by weight or greater with respect to 100 parts by weight of a binder resin in the toner particles.

The styrene acrylic resin is a copolymer of a styrene monomer and an acrylic monomer or a copolymer of a styrene monomer, an acrylic monomer, and other one or more vinyl monomers.

Examples of the styrene monomer include styrene, o-methyl styrene, m-methyl styrene, p-methyl styrene, α-methyl styrene, p-ethyl styrene, 2,4-dimethyl styrene, p-n-butyl styrene, p-tert-butyl styrene, p-n-hexyl styrene, p-n-octyl styrene, p-n-dodecyl styrene, p-methoxy styrene, p-phenyl styrene, p-chlorostyrene, and 3,4-dichlorostyrene, these may be used alone or in combination of two or more monomers thereof.

Examples of the acrylic monomer include acrylic acid, methacrylic acid, acrylic acid ester, and methacrylic acid ester, and these may be used alone or in combination of two or more kinds thereof.

Specific examples of acrylic acid ester and methacrylic acid ester include 2-chloroethyl acrylate, phenyl (meth) acrylate, methyl α-chloroacrylate, 2-hydroxyethyl (meth) acrylate, 2-hydroxypropyl (meth)acrylate, 2-hydroxybutyl (meth)acrylate, glycidyl (meth)acrylate, dimethylaminoethyl methacrylate, diethylaminoethyl methacrylate, bisglycidyl methacrylate, polyethylene glycol dimethacrylate, and methacryloxy ethyl phosphate in addition to alkyl ester of (meth)acrylate such as methyl (meth)acrylate, ethyl (meth) acrylate, propyl (meth)acrylate, n-butyl (meth)acrylate, isobutyl (meth)acrylate, n-octyl (meth)acrylate, dodecyl (meth)acrylate, 2-ethylhexyl acrylate, or stearyl (meth)acrylate. These may be used alone or in combination of two or more kinds thereof. In addition, the above-described "(meth) acryl" indicates one or both of acryl and methacryl.

Examples of the vinyl monomer include an olefin monomer such as ethylene, propylene, butylene, butadiene, or isoprene; a vinyl ester monomer such as vinyl formate, vinyl acetate, vinyl propionate, or vinyl benzoate; unsaturated dicarboxylic acid such as fumaric acid, maleic acid, citraconic acid, or itaconic acid and a monoester derivative thereof or a diester derivative thereof; succinic acid mono (meth)acryloyloxyethyl ester; (meth)acrylonitrile; and acrylamide. These may be used alone or in combination of two or more kinds thereof.

The weight average molecular weight Mw of the styrene acrylic resin is preferably in the range of 100,000 to 1,000,000. When the weight average molecular weight Mw of the styrene acrylic resin is less than 100,000, the strength of toner particles or the strength of an image after fixation may be insufficient. Meanwhile, the weight average molecular weight Mw thereof exceeds 1,000,000, the fixing properties may be deteriorated.

It is preferable that the styrene acrylic resin contains an acidic group in a molecule. It is considered that a polyamine tend to be easily adhered to the surface of the toner particles and thus the positive charging properties become excellent when the styrene acrylic resin contains an acidic group in a molecule. Examples of the acidic group include a carboxylic group and a sulfonic acid group.

The acid value of the styrene acrylic resin is preferably in the range of 1 mgKOH/g to 50 mgKOH/g and more preferably in the range of 5 mgKOH/g to 20 mgKOH/g. When the acid value of the styrene acrylic acid is less than 1 mgKOH/g, positive charging may be insufficient. Meanwhile, when the acid value thereof exceeds 50 mgKOH/g, the charging properties may be deteriorated.

The toner particles according to the exemplary embodiment may include a resin other than a polyester resin and a styrene acrylic resin. Examples of the resin other than the styrene acrylic resin, which are not particularly limited, include an epoxy resin, a polyurethane resin, a polyamide resin, a cellulose resin, and a polyether resin. These resins may be used alone or in combination of two or more kinds thereof.

The content of the binder resin is in the range of 80% by weight to 95% by weight with respect to the entirety of the toner particles.

The toner particles may contain a colorant and other additives such as a wax, a charge-controlling agent, silica powder, and metal oxides if necessary in addition to a binder resin. These additives may be internally added by kneading into a binder resin or externally added by applying a mixing treatment after a toner is obtained as particles.

As the colorant used in the exemplary embodiment, a known pigment or dye may be used. Specifically, respective pigments of yellow, magenta, cyan, and black described below are preferably used.

As a pigment of yellow, a compound represented by a condensed azo compound, an isoindolinone compound, an anthraquinone compound, an azo metal complex compound, a methine compound, or an allyl amide compound is used. Specific examples of the pigments to be preferably used include C.I. Pigments Yellow 12, 13, 14, 15, 17, 62, 74, 83, 93, 94, 95, 97, 109, 110, 111, 120, 127, 128, 129, 147, 168, 174, 176, 180, 181, 185, and 191. Among these, C. I. Pigments Yellow 151, 180, and 185 are excellent in terms of color reproducibility and not containing halogen.

As a pigment of magenta, a condensed azo compound, a diketopyrrolopyrrole compound, anthraquinone, a quinacridone compound, a basic dye lake compound, a naphthol compound, a benzimidazolone compound, a thioindigo compound, or a perylene compound is used. Specific examples of the pigments to be preferably used include C. I. Pigments Red 2, 3, 5, 6, 7, 23, 48:2, 48:3, 48:4, 57:1, 81:1, 122, 144, 146, 166, 169, 177, 184, 185, 202, 206, 220, 221, and 254. Among these, C. I. Pigment Red 122 of a quinacridone pigment is excellent in terms of color reproducibility and not containing halogen.

As a pigment of cyan, a copper phthalocyanine compound, a derivative thereof, an anthraquinone compound, or a basic dye lake compound is preferably used. Specific examples of the pigments to be preferably used include C. I. Pigments Blue 1, 7, 15, 15:1, 15:2, 15:3, 15:4, 60, 62, and 66. Among these, C. I. Pigment Blue 15:3 is excellent in terms of color reproducibility and not containing halogen.

As a pigment of black, carbon black, aniline black, acetylene black, or iron black is preferably used.

The content of the colorant is preferably in the range of, for example, 5% by weight to 20% by weight with respect to the entirety of toner particles.

Examples of the release agent, which are not particularly limited, include vegetable waxes such as a carnauba wax, a sugar wax, and a Japan wax; animal waxes such as a bees wax, an insect wax, a whale wax, and a wool wax; and synthetic hydrocarbon waxes such as a Fischer-Tropsch wax (FT wax) having an ester in the side chain thereof, a polyethylene wax, and a polypropylene wax. Among these, an FT wax having an ester in the side chain thereof or a polyethylene wax is preferable in terms of dispersibility. The wax may be used alone or in combination of two or more kinds thereof.

The content of the release agent is, for example, in the range of 0.1% by weight to 10% by weight with respect to the entirety of toner particles.

The charge-controlling agent is not particularly limited and a known charge-controlling agent in the related art may be used. Examples thereof include a positively chargeable charge-controlling agent such as a nigrosine dye, a fatty acid-modified nigrosine dye, a carboxyl group-containing fatty acid-modified nigrosine dye, quaternary ammonium salts, an amine compound, an amide compound, an imide compound, or an organic metal compound; and a negatively chargeable charge-controlling agent such as a metal complex of oxycarboxylic acid, a metal complex of an azo compound, a metal complex dye, or a salicylic acid derivative. The charge-controlling agent may be used alone or in combination of two or more kinds thereof.

Examples of the metal oxide, which are not particularly limited, include titanium oxide, aluminum oxide, magnesium oxide, zinc oxide, strontium titanate, barium titanate, magnesium titanate, and calcium titanate. The metal oxide may be used alone or in combination of two or more kinds thereof.

Method of Preparing Toner Particles

The toner particles may be prepared by a known production method in the related art for a known pulverized toner, an in-liquid emulsified dry toner, a pulverized toner from in-liquid precipitation, or a so-called chemical toner accompanied by coalescence of emulsified particles. In a case where the toner particles are used as a liquid developer, the obtained toner particles described above are dispersed in carrier oil, and the diameter of toner particles may be reduced through pulverization using a pulverizing machine such as a ball mill or an attritor according to the necessity.

For example, a binder resin, a wax, a colorant if necessary, and other additives are put into a mixing device such as a HENSCHEL mixer and mixed with each other, the mixture is molten-kneaded using a twin-screw extruder or the like, the mixture is cooled using a drum flaker or the like, the mixture is coarsely pulverized using a pulverizer such as a hammer mill and further minutely pulverized using a pulverizer such as a jet mill, and classification is performed using an air classifier or the like, thereby obtaining a pulverized toner.

Further, a binder resin, a wax, a colorant if necessary, and other additives are dissolved in a solvent such as ethyl acetate, the resultant is emulsified and suspended in water to which a dispersion stabilizer such as calcium carbonate is added, the solvent is removed, and then particles obtained by removing the dispersion stabilizer are filtered and dried, thereby obtaining an in-liquid emulsified dry toner.

A binder resin, a wax, a colorant if necessary, and other additives are dissolved in a solvent such as tetrahydrofuran (THF), toluene, or N,N-dimethylformamide (DMF), the obtained solution is added dropwise to a poor solvent such as alcohol to be deposited and precipitated, and the precipitate is filtered, dried, pulverized, and classified as in the above-described pulverized toner, and then a toner may be obtained.

Further, a composition containing polymerizable monomers forming a binder resin, a colorant, a polymerization initiator (for example, benzoyl peroxide, lauroyl peroxide, isopropyl peroxycarbonate, cumene hydroperoxide, 2,4-dichlorobenzoyl peroxide, or methyl ethyl ketone peroxide), and other additives is added to a water phase under stirring to be granulated, and the granulated particles are subjected to a polymerization reaction, filtered, and dried, and thus a polymerized toner particles may be obtained.

A method including performing phase inversion emulsification on a toner constituent material, which is dissolved in a solvent, in a poor solvent, aggregating and granulating the emulsion using a coagulant or a salt thereof, and removing the solvent; and a method including mixing each emulsion of toner constituent materials to each other and aggregating mixed emulsions using a coagulant or salts to obtain particles may be exemplified.

In addition, the mixing ratio of respective materials (a binder resin, a colorant, a wax, and other additives) at the time of obtaining a toner is not particularly limited and may be appropriately set using a known technique in the related art. When a liquid developer is prepared, the obtained toner may be made into toner particles for a liquid developer by being finely pulverized in carrier oil using a known pulverizing device such as a ball mill, a beads mill, or a high-pressure wet micronizing device.

In the exemplary embodiment, in a case where the surface of the toner particles is treated using a polyamine, in terms of ease of the surface treatment using a polyamine, it is preferable that the toner particles are toner particles obtained by aggregating a dispersion containing resin particles containing a binder resin and colorant particles in an aqueous medium. Since a polyamine is a water-soluble polymer, a polyamine may be adsorbed by the surface of toner particles after washing with water and before a drying process according to the wet method of granulating toner particles in a liquid.

Characteristics of Toner Particles

A volume average particle diameter D50v of the toner particles is preferably in the range of 0.5 μm to 5.0 μm. When the volume average particle diameter D50v is in the above-described range, adhesion force is increased and developing properties are improved. Further, the resolution of an image is improved. The volume average particle diameter D50v of the toner particles is more preferably in the range of 0.8 μm to 4.0 μm and still more preferably in the range of 1.0 μm to 3.0 μm.

The volume average particle diameter D50v, the number average particle size distribution index (GSDp), and the volume average particle size distribution index (GSDv) of the toner particles are measured using a laser diffraction/scattering particle size distribution measuring device, for example, LA920 (manufactured by Horiba, Ltd.). Cumulative distributions of the volume and the number are drawn from the small diameter side with respect to the particle size range (channel) divided based on the measured particle size distribution, and the particle diameter corresponding to 16% cumulation is defined as a volume particle diameter D16v and a number particle diameter D16p, the particle diameter corresponding to 50% cumulation is defined as a volume particle diameter D50v and a number particle diameter D50p, and the particle diameter corresponding to 84% cumulation is defined as a volume particle diameter D84v and a number particle diameter D84p. Using these definitions, the volume average particle size distribution index (GSDv) is calculated as $(D84v/D16v)^{1/2}$ and the number average particle size distribution index (GSDp) is calculated as $(D84p/D16p)^{1/2}$.

Carrier Liquid

A carrier liquid is an insulating liquid for dispersing toner particles and is not particularly limited, but an insulating liquid having silicone oil as a main component is preferable. Silicone oil may be used alone or a mixed solution of silicone oil with other insulating liquid may be used. Examples of the silicone oil include KF96 (manufactured by Shin-Etsu Chemical Co., Ltd.), SH200, SH344 (both manufactured by Dow Corning Toray Co., Ltd.), and TSF451 (manufactured by GE Toshiba Silicones Co., Ltd.). Further, the liquid which may be mixed is not particularly limited and examples thereof include an aliphatic hydrocarbon solvent such as paraffin oil (as the commercially available products, MORESCO WHITE MT-30P, MORESCO WHITE P40, and MORESCO WHITE P70 manufactured by MATSUMURA OIL Co., Ltd., and ISOPAR L and ISOPAR M manufactured by Exxon Chemical Co., Ltd.); a hydrocarbon solvent such as naphthenic oil (as the commercially available products, EXXSOL D80, EXXSOL D110, EXXSOL D130 manufactured by Exxon Chemical Co., Ltd., NAPHTESOL L, NAPHTESOL M, NAPHTESOL H, New NAPHTESOL 160, New NAPHTESOL 200, New NAPHTESOL 220, and New NAPHTESOL MS-20P manufactured by Nippon Petrochemical Co., Ltd.). An aromatic compound such as toluene may be contained in the above-described examples. Further, the expression "containing silicone oil as a main component" means that 50% by weight or more silicone oil is contained in the carrier liquid.

For example, the volume resistivity of the carrier liquid is included in the range of $1.0\times10^{10}\Omega\cdot cm$ to $1.0\times10^{14}\Omega\cdot cm$, and may be in the range of $1.0\times10^{10}\Omega\cdot cm$ to $1.0\times10^{13}\Omega\cdot cm$.

The viscosity of the carrier liquid is preferably in the range of 1 mPas to 100 mPas, more preferably in the range of 1 mPas to 80 mPas, and still more preferably in the range of 1 mPas to 60 mPas in terms of stead shear viscosity at 25° C. When the steady shear viscosity is less than 1 mPas, the molecular weight of silicone oil or the like may be decreased. In addition, when the steady shear viscosity is greater than 100 mPas, since the viscosity of the developer using the carrier oil is increased, desired characteristics may not be obtained.

The carrier liquid may include various types of auxiliary materials, for example, a dispersion agent, an emulsifying agent, a surfactant, a stabilizing agent, a wetting agent, a thickening agent, a foaming agent, an antifoaming agent, a coagulant, a gelling agent, an anti-settling agent, a charge-controlling agent, an antistatic agent, an antioxidant, a softening agent, a plasticizer, a filler, a flavoring agent, an adhesion-preventing agent, and a release agent.

It is preferable that the liquid developer according to the exemplary embodiment contains a carboxyl group-containing silicone. A liquid developer having more excellent positive charging characteristics is realized when toner particles whose surface is treated by a polyamine are used as toner particles and a carboxyl group-containing silicone is contained in the liquid developer obtained by dispersing toner particles containing a binder resin in a carrier liquid.

As the carboxylic group-containing silicone, a compound represented by the formula (II) is exemplified. The compound represented by the formula (II) is highly cationic and tends to be positively charged.

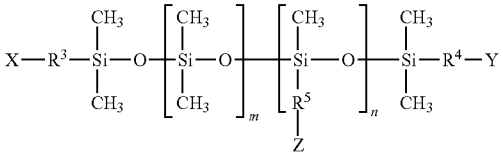

(II)

(In the formula (II), X, Y, and Z each independently represent a hydrogen atom or a carboxyl group and at least one of X, Y, and Z represents a carboxyl group. m represents an integer of 1 to 1,000 and n represents an integer of 1 to 10. $R^3$, $R^4$, and $R^5$ each independently represent a single bond or a divalent aliphatic hydrocarbon group having 1 to 20 carbon atoms.)

In the formula (II), at least one of X, Y, and Z may represent a carboxyl group, two of X, Y, and Z may represent a carboxyl group, and all of X, Y, and Z may represent a carboxyl group.

In the formula (II), $R^3$, $R^4$, and $R^5$ each independently represent a single bond or a divalent aliphatic hydrocarbon group having 1 to 20 carbon atoms and preferably represent a single bond or a divalent aliphatic hydrocarbon group having 3 to 12 carbon atoms. Examples of the divalent hydrocarbon group having 1 to 20 carbon atoms include a methylene group, an ethylene group, a trimethylene group, a tetramethylene group, a hexamethylene group, an octamethylene group, a decamethylene group, an undecamethylene group, a dodecamethylene group, a hexadecamethylene group, and an octadecamethylene group. Among these, a trimethylene group, a tetramethylene group, a hexamethylene group, an octamethylene group, a decamethylene group, an undecamethylene group, and a dodecamethylene group are preferable.

In the formula (II), m represents an integer of 1 to 1,000 and preferably represents an integer of 5 to 100. In the formula (II), n represents an integer of 1 to 10 and preferably represents an integer of 1 to 5.

The amount of the carboxyl group-containing silicone in the liquid developer is preferably in the range of 0.001 parts by weight to 10 parts by weight and more preferably in the range of 0.01 parts by weight to 1 part by weight with respect to 100 parts by weight of the liquid developer. When the amount of the carboxyl group-containing silicone with respect to the liquid developer is less than 0.001 parts by weight with respect to 100 parts by weight of the liquid developer, charging properties may deteriorated. Meanwhile, when the amount thereof exceeds 10 parts by weight, conductivity is excessively increased and thus the charging properties may be deteriorated.

The weight average molecular weight of the carboxyl group-containing silicone is preferably in the range of 100 to 100,000 and more preferably in the range of 1,000 to 10,000. When the weight average molecular weight of the carboxyl group-containing silicone is less than 100, the compatibility with the liquid developer may not be sufficient. Meanwhile, when the weight average molecular weight thereof exceeds 100,000, fixing properties of the developer may be deteriorated.

Method of Producing Liquid Developer

The liquid developer according to the exemplary embodiment is obtained by mixing and pulverizing the above-described toner particles and the carrier liquid using a disperser such as a ball mill, a sand mill, an attritor, or a bead mill, and dispersing the toner particles in the carrier liquid. In addition, the dispersion of the toner particles in the carrier liquid is not limited to the disperser, and the dispersion may be performed by rotating special stirring blades such as a mixer at a high speed, by shearing force of a rotor and stator known as a homogenizer, or by ultrasonic waves.

From a viewpoint of appropriately controlling a viscosity of the developer and smoothly circulating the developing liquid in a developing machine, the concentration of the toner particles in the carrier liquid is preferable in the range of 0.5% by weight to 40% by weight, and more preferably in the range of 1% by weight to 30% by weight.

Thereafter, the obtained dispersion may be filtered with a filter such as a membrane filter with a pore diameter of approximately 100 μm to remove waste and coarse particles.

Developer Cartridge, Process Cartridge, and Image Forming Apparatus

An image forming apparatus according to the exemplary embodiment includes, for example, an image holding member (hereinafter, also referred to as a "photoreceptor"); a charging unit that charges the surface of the image holding member; a latent image forming unit that forms a latent image (electrostatic latent image) on the surface of the image holding member; a developing unit that develops the latent image formed on the surface of the image holding member using the liquid developer according to the exemplary embodiment which is held on the surface of a developer holding member to form a toner image; a transfer unit that transfers the toner image formed on the surface of the image holding member onto a recording medium; and a fixing unit that fixes the toner image transferred onto the recording medium to the recording medium to form a fixed image.

Further, an image forming method according to the exemplary embodiment includes a latent image forming process of forming a latent image on the surface of an image holding member; a developing process of developing the latent image formed on the surface of the image holding member using the liquid developer according to the exemplary embodiment which is held on the surface of the developer holding member to form a toner image; a transfer process of transferring the toner image formed on the surface of the image holding member onto a recording medium; and a fixing process of fixing the toner image transferred onto the recording medium to the recording medium to form a fixed image.

In the image forming apparatus, for example, a portion including a developing unit may have a cartridge structure (process cartridge) which is detachable from a main member of the image forming apparatus. The process cartridge is not particularly limited as long as the process cartridge accommodates the liquid developer according to the exemplary embodiment. The process cartridge accommodates the liquid developer according to the exemplary embodiment, includes a developing unit that develops the latent image formed on the image holding member with the liquid developer to form the toner image, and is detachable from the image forming apparatus.

In addition, the developer cartridge according to the exemplary embodiment is not particularly limited as long as the developer cartridge has a container which accommodates the liquid developer according to the exemplary embodiment. The developer cartridge accommodates the liquid developer according to the exemplary embodiment, and is detachable from the image forming apparatus including the developing unit that develops the latent image formed on the image holding member with the liquid developer to form the toner image.

Hereinafter, an example of an image forming apparatus using the liquid developer according to the exemplary embodiment will be described with reference to the accompanying FIGURE.

FIG. 1 is a configuration view schematically illustrating an example of the image forming apparatus according to the exemplary embodiment. An image forming apparatus 100 includes a photoreceptor (image holding member) 10; a charging device (charging unit) 20; an exposure device (latent image forming unit) 12; a developing device (developing unit) 14; an intermediate transfer member (transfer unit) 16; a cleaner (cleaning unit) 18; and a transfer fixation roller (transfer unit, fixing unit) 28. The photoreceptor 10 is cylindrical and the charging device 20, the exposure device 12, the developing device 14, the intermediate transfer member 16, and the cleaner 18 are sequentially provided on the outer periphery of the photoreceptor 10.

Hereinafter, operations of the image forming apparatus 100 are described.

The charging device 20 charges the surface of the photoreceptor 10 to a predetermined potential (charging process), and the exposure device 12 forms a latent image (electrostatic latent image) by exposing the charged surface with laser beams or the like based on an image signal (latent image forming process).

The developing device 14 includes a developing roller 14*a* and a developer accommodating container 14*b*. The developing roller 14*a* is installed so that a portion thereof is immersed in a liquid developer 24 accommodated in the developer accommodating container 14*b*. The liquid developer 24 includes an insulating carrier liquid, toner particles containing a binder resin, and the charge-controlling agent.

Though the toner particles are dispersed in the liquid developer 24, for example, the positional variation of concentrations of the toner particles in the liquid developer 24 is decreased, by continuously stirring the liquid developer 24 with a stirring member provided in the developer accommodating container 14*b*. Accordingly, the liquid developer 24 in which the positional variation of the concentrations of the toner particles is decreased is supplied to the developing roller 14*a* that rotates in an arrow A direction in FIG. 1.

The liquid developer 24 supplied to the developing roller 14*a* is transported to the photoreceptor 10 in a state of being regulated to a certain supply amount by a regulation member, and is supplied to the electrostatic latent image in a position in which the developing roller 14*a* and the photoreceptor 10 are close to each other (or come into contact with each other). Accordingly, the electrostatic latent image is developed to become a toner image 26 (developing process).

The developed toner image 26 is transported to the photoreceptor 10 that rotates in an arrow B direction in FIG. 1, and is transferred to paper (recording medium) 30. However, according to the exemplary embodiment, before the toner image is transferred to the paper 30, in order to enhance the transfer efficiency to the recording medium together with the separation efficiency of the toner image from the photoreceptor 10 and to cause the toner image to be fixed at the same time as being transferred to the recording medium, the toner image is once transferred to the intermediate transfer member 16 (intermediate transfer process). At this point, the circumferential speed between the photoreceptor 10 and the intermediate transfer member 16 may be provided.

Subsequently, the toner image transported in an arrow C direction by the intermediate transfer member 16 is fixed at the same time as being transferred to the paper 30 in a contact position with the transfer fixation roller 28 (transfer process and fixing process). The paper 30 is interposed between the transfer fixation roller 28 and the intermediate transfer member 16, and the toner image on the intermediate transfer member 16 is in contact with the paper 30. Accordingly, the toner image is transferred to the paper 30, and the toner image is fixed on the paper, to be a fixed image 29. It is preferable that the toner image is fixed by providing a heating member on the transfer fixation roller 28 and pressurizing and heating the toner image. The fixation temperature is, generally, in the range of 120° C. to 200° C.

If the intermediate transfer member 16 has a roller shape as illustrated in FIG. 1, the intermediate transfer member 16 and the transfer fixation roller 28 configure a roller pair. Therefore, the intermediate transfer member 16 and the transfer fixation roller 28 respectively correspond to a fixation roller and a pressurization roller in a fixing device, and exhibit a fixing function. That is, if the paper 30 passes through a nip formed between the intermediate transfer member 16 and the transfer fixation roller 28, the toner image is transferred and also is heated and pressurized with respect to the intermediate transfer member 16 by the transfer fixation roller 28. Accordingly, the toner image permeates into fibers of the paper 30 while the binder resins in the toner particles that configure the toner image are softened, so that the fixed image 29 is formed on the paper 30.

According to the exemplary embodiment, the image is transferred to and fixed on the paper 30 at the same time, but the transfer process and the fixation process may be respectively performed so that the image is fixed after being transferred. In this case, the transfer roller that transfers the toner image from the photoreceptor 10 has a function corresponding to the intermediate transfer member 16.

Meanwhile, in the photoreceptor 10 that transfers the toner image 26 to the intermediate transfer member 16, remaining toner particles that are not transferred are moved to a contact position with the cleaner 18, and collected by the cleaner 18. In addition, if the transfer efficiency is near 100%, and the remaining toner does not cause problems, the cleaner 18 may not be provided.

The image forming apparatus 100 may further include an erasing device (not illustrated) that erases the surface of the photoreceptor 10 after transfer and before next charging.

All of the charging device 20, the exposure device 12, the developing device 14, the intermediate transfer member 16, the transfer fixation roller 28, and the cleaner 18 which are included in the image forming apparatus 100 may be operated in synchronization with the rotation speed of the photoreceptor 10.

EXAMPLES

Hereinafter, the invention is more specifically described with reference to Examples and Comparative Examples, but the invention is not limited to the following Examples.

Example 1

Preparation of Liquid Developer 40 parts by weight of a cyan pigment (C. I. Pigment Blue 15:3, manufactured by Clariant, Ltd.) are added to 60 parts by weight of styrene acrylic resin (manufactured by Fujikura Kasei Co., Ltd., styrene-acrylic acid resin (molar ratio: 60:40), weight average molecular weight: 380,000), and the mixture is kneaded by a pressure kneader. The kneaded material is coarsely pulverized and a cyan pigment masterbatch is prepared.

Next, a mixture having the following composition is dissolved and dispersed in a ball mill for 24 hours.

Styrene acrylic resin (manufactured by Fujikura Kasei Co., Ltd., styrene-n-butylacrylate resin (molar ratio: 60:40), weight average molecular weight: 320,000, acid value: 10 mgKOH/g): 75 parts by weight The cyan pigment masterbatch: 25 parts by weight Ethyl acetate: 100 parts by weight The acid value of the resin is calculated from the standardized amount of a 0.1N potassium hydroxide/alcohol solution obtained by dissolving 10 mg of a sample in 50 mL of toluene and performing titration by a standardized 0.1N potassium hydroxide/alcohol solution using a mixed indicator of 0.1% of bromothymol blue and phenol red.

20 parts by weight of calcium carbonate (manufactured by Maruo Calcium Co., Ltd., LUMINOUS) are added, as a dispersion stabilizer, to an aqueous solution obtained by dissolving 20 parts by weight of sodium chloride (manufactured by Wako Pure Chemical Industries, Ltd.) in 135 parts by weight of ion exchange water, and the solution is dispersed using a ball mill for 24 hours to be used as a dispersion medium. 100 parts by weight of the mixture are put into 170 parts by weight of the dispersion medium and emulsified using an emulsification device (manufactured by IKA, ULTRA-TURRAX T-50) at 10,000 rpm for 3 minutes, thereby obtaining a suspension. The suspension is put into a separable flask provided with a stirrer, a thermometer, a cooling tube, and a nitrogen inlet tube, stirring is performed at 35° C. for 3 hours while flowing nitrogen thereinto from the nitrogen inlet tube, and ethyl acetate is distilled. The temperature is cooled to 20° C., calcium carbonate is decomposed by adding a 10% hydrochloric acid aqueous solution to the mixture, and then solid-liquid separation is performed by centrifugation. The obtained particles are re-dispersed in 1,000 parts by weight of ion exchange water and centrifugation is performed again. This operation is repeated two times and the particles are washed and then dried in a vacuum at 40° C., thereby obtaining toner base particles. The toner base particles are pulverized using a jet mill and then toner particles whose volume average particle diameter is 4.0 μm are obtained.

Surface Modification of Toner Particles 780 parts by weight of ion exchange water, 10 parts by weight of a cationic surfactant (DOWFAX 2A1, manufactured by Dow Chemical Company, solid content concentration: 45% by weight), and 60 parts by weight of a 10 wt % sodium carbonate aqueous solution are added to 150 parts by weight of dried toner particles and dispersed in water using ULTRA-TURRAX T-50. Toner particles are separated from a suspension of toner particles through centrifugation, the obtained particles are re-dispersed in 1,000 parts by weight of ion exchange water, and then centrifugation is performed again. This operation is repeated twice, the particles are washed, and 100 parts by weight of the obtained toner particles are added to 900 parts by weight of ion exchange water to prepare a dispersion (solid content concentration: 15% by weight). The pH thereof is adjusted to 1.5 by adding 1 N of hydrochloric acid to the dispersion, the solution is stirred for 10 minutes, 5 parts by weight of polyethyleneimine (manufactured by JUNSEI CHEMICAL CO., LTD., weight average molecular weight: 70,000, solid content concentration: 30% by weight) are added thereto, and the solution is stirred for 60 minutes.

Next, solid-liquid separation is performed by centrifugation, the supernatant liquid is eliminated, and extra polyethyleneimine is removed. Ion exchanged water is added, stirring is performed for 10 minutes, and centrifugation is repeated until the conductivity of the washing solution becomes 20 μS/cm or less. The particles are filtered using filter paper (No4A, manufactured by Advantech Co., Ltd.), washed with ion exchange water, dried at 35° C. for 24 hours (moisture content: 0.5% by weight), and then crushed, thereby obtaining toner particles whose volume average particle diameter is 4.0 μm. The amount of sodium ions of the toner is 0.038 mg with respect to 1 g of the toner particles.

Preparation of Developer 100 parts by weight of the obtained toner particles whose surface is modified are mixed with 233 parts by weight of paraffin oil (P-40, manufactured by Matsumura Oil. Co. Ltd.), and the liquid developer having a solid content concentration of 30% by weight is prepared.

Evaluation of Charging Characteristics

Charging Polarity

Two sheets of ITO glass substrates (100Ω/square, manufactured by EHC Inc.) processed to have a dimension of 5 cm×1 cm are fixed so that a NAFLON sheet (1 cm×1 cm×1.0 mm, manufactured by AS ONE Corporation) as an insulating spacer is interposed between the substrates such that the electrode surfaces of the substrates become inward. 1 mL of a liquid developer sample is put in a disposable cell (12 mm×12 mm×45 mm, manufactured by AS ONE Corporation), the above-described electrode substrates are immersed therein, 250 V of a DC voltage is applied thereto for 30 seconds, the electrodes are pulled up in a state in which the voltage is applied, the state of particles being adhered to the positive and negative ITO electrode surfaces is observed, and the charging characteristics are determined. The results thereof are shown in Table 1. In addition, when the charging characteristics below show positive and negative (±), this means that particles having positive polarity and particles having negative polarity are evenly mixed with each other, but fogging occurs in a bright image portion in an actual system of a developer exhibiting such characteristics. Therefore, such developer is not suitable for both of a positively charged system and a negatively charged system.

+: The particles are only adhered to a negative electrode.

−: The particles are only adhered to a positive electrode.

±: The particles are adhered to both electrodes.

×: The particles are not adhered to either electrodes.

Charging Strength

With respect to the liquid developers obtained in the respective examples and respective comparative examples, the potential difference is measured by using a "microscope type laser zeta-potential meter" ZC-3000 manufactured by Microtec Nition Co., Ltd. to evaluate the potential difference based on the following five-grade criteria. The measurement is carried out by diluting the liquid developer with a diluent solvent, placing the dilution in a 10 mm transparent cell, applying a voltage of 300 V at a gap between electrodes of 9 mm, and simultaneously observing the speed of movement of the particles in the cell with a microscope. Thus, the speed of movement is calculated, and the zeta potential is determined from the speed of movement value. The results are shown in Table 1.

A: Potential difference is equal to or greater than +100 mV (very good)

B: Potential difference is equal to or greater than +85 mV and less than +100 mV (good)

C: Potential difference is equal to or greater than +70 mV and less than +85 mV (normal)

D: Potential difference is equal to or greater than +50 mV and less than +70 mV (slightly poor)

E: Potential difference is less than +50 mV (very poor)

In addition, the toner particles may be collected from the liquid developer by the following method. The liquid developer is precipitated by centrifugation (1,000 rpm×5 minutes), the supernatant liquid is removed by decantation, and the toner particles are taken out. The taken-out toner particles are washed with hexane or Isopar (the mixed solvent may be appropriately changed depending on a toner resin).

Example 2

Synthesis of Amorphous Polyester Resin (1)

80 parts by mole of polyoxypropylene(2,2)-2,2-bis(4-hydroxyphenyl)propane, 20 parts by mole of polyoxyethylene(2,2)-2,2-bis(4-hydroxyphenyl)propane, 50 parts by mole of terephthalic acid, 25 parts by mole of fumaric acid, and 25 parts by mole of n-dodecenylsuccinic acid as raw materials and dibutyltin oxide as a catalyst are put into a heated and dried two-necked flask, nitrogen gas is introduced into the container to be kept in an inert environment, the temperature therein is increased, a co-polycondensation reaction is performed in the temperature range of 150° C. to 230° C. for about 12 hours, and the pressure is slowly reduced in the temperature range of 210° C. to 250° C., and thus an amorphous polyester resin (1) is synthesized. The weight average molecular weight (Mw) of the obtained amorphous polyester resin (1) is 17,900. Further, the acid value of the amorphous polyester resin (1) is 14.6 mgKOH/g. Further, the melting temperature of the amorphous polyester resin (1) is obtained through measurement using a differential scanning calorimeter (DSC) and analysis according to JIS standard (see JIS K-7121). As a result, a change in stepwise endothermic amount without showing a clear peak is observed. The glass transition temperature (Tg) determined by employing the intermediate point in the change of the stepwise endothermic amount is 60° C.

Synthesis of Amorphous Polyester Resin (2)

An amorphous polyester resin (2) is synthesized in the same manner as that of the amorphous polyester resin (1) except that 50 parts by mole of polyoxyethylene(2,0)-2,2-bis(4-hydroxyphenyl)propane, 40 parts by mole of polyoxypropylene(2,2)-2,2-bis(4-hydroxyphenyl)propane, 10 parts by mole of ethylene glycol, 50 parts by mole of terephthalic acid, 15 parts by mole of isophthalic acid, 30 parts by mole of dodecenylsuccinic acid, and 5 parts by mole of 1,2,4-trimellitic acid are put into a heated and dried two-necked flask as raw materials. The weight average molecular weight (Mw) of the obtained amorphous polyester resin (2) is 12,000. Further, the acid value of the amorphous polyester resin (2) is 21 mgKOH/g. Further, the melting temperature of the amorphous polyester resin (2) is obtained through measurement using a differential scanning calorimeter (DSC). As a result, a change in stepwise endothermic amount without showing a clear peak is observed. The glass transition temperature (Tg) determined by employing the intermediate point in the change of the stepwise endothermic amount is 65° C.

Synthesis of Crystalline Polyester Resin (1)

43.4 parts by weight of dimethyl sebacate, 32.8 parts by weight of 1,10-decanediol, and 27 parts by weight of dimethyl sulfoxide, and 0.03 parts by weight of dibutyl tin oxide as a catalyst are put into a heated and dried three-necked flask, nitrogen gas is introduced into the container so that the air is changed into an inert atmosphere by a decompression operation, and then 4 hours of mechanical stirring is performed at 180° C. Under the reduced pressure, dimethyl sulfoxide is distilled, the temperature therein is slowly increased to 220° C. under the reduced pressure, stirring is performed for 1.5 hours, the air-cooling is performed when the contents in the container enters a viscous state, and the reaction is stopped, and thus 65 parts by weight of an aliphatic crystalline polyester resin (1) is synthesized. When the molecular weight is measured in the same manner as that of the amorphous polyester resin (1), the weight average molecular weight (Mw) of the obtained crystalline polyester resin (1) is 22,000. Further, when the melting temperature is measured in the same manner as that of the amorphous polyester resin (1) and the DSC spectrum is obtained, the crystalline polyester resin (1) shows a clear peak and the melting temperature (Tm1) is 77° C.

Preparation of Liquid Developer 40 parts by weight of a yellow pigment (C. I. Pigment Yellow 185, manufactured by BASF Japan, Ltd.) is added to 60 parts by weight of the amorphous polyester resin (1), and the mixture is kneaded by a pressure kneader. The kneaded material is coarsely pulverized to thereby obtain a yellow pigment masterbatch. Next, a mixture having the following composition is put into a sealed reaction container in which a dissolver is installed and is dissolved and dispersed for 3 hours while being warmed at a temperature of 40° C.

The above-described yellow pigment masterbatch: 25 parts by weight

Amorphous polyester resin (2): 65 parts by weight

Crystalline polyester resin (1): 10 parts by weight

Ethyl acetate: 400 parts by weight 30 parts by weight of calcium carbonate (manufactured by Maruo Calcium Co., Ltd., LUMINOUS) and 3.5 parts by weight of carboxy methyl cellulose (manufactured by Daiichi Kogyo Seiyaku Co., Ltd., CELLOGEN) are added, as a dispersion stabilizer, to an aqueous solution obtained by dissolving 28 parts by weight of sodium chloride (manufactured by Wako Pure Chemical Industries, Ltd.) in 160 parts by weight of ion exchange water, and the solution is dispersed using a ball mill for 24 hours to be used as a dispersion medium. 120 parts by weight of the mixture is put into 200 parts by weight of the dispersion medium and emulsified using an emulsification device (manufactured by IKA, ULTRA-TURRAX T-25) at 10,000 rpm for 3 minutes, thereby obtaining an emulsion. The emulsion is moved to a container in which a stirrer is installed, ethyl acetate is removed while blowing nitrogen, and calcium carbonate is decomposed by hydrochloric acid, thereby obtaining a suspension of toner particles. Toner particles are separated from the suspension of the toner particles by centrifugation, washed with ion exchange water in the same manner as in Example 1, and dried in a vacuum at 40° C.

Surface Modification of Toner Particles 780 parts by weight of ion exchange water, 10 parts by weight of a cationic surfactant (DOWFAX 2A1, manufactured by Dow Chemical Company, solid content concentration: 45% by weight), and 60 parts by weight of a 10 wt % sodium carbonate aqueous solution are added to 150 parts by weight of dried toner particles and pulverized in a ball mill. Toner particles are separated from a suspension of toner particles through centrifugation and washed with ion exchange water in the same manner as in Example 1, and then 100 parts by weight of the obtained toner particles are added to 900 parts by weight of ion exchange water to prepare a dispersion (solid content concentration: 15% by weight). The pH thereof is adjusted to 1.5 by adding 1 N of hydrochloric acid to the dispersion, the solution is stirred for 10 minutes, solid-liquid separation is performed by centrifugation, the supernatant liquid is eliminated, and extra acids are removed. Subsequently, 900 parts by weight of ion exchange water is added thereto for dispersion, 10 parts by weight of polyallylamine PAA-1112 (15 wt % solution, manufactured by Nittobo Medical, Inc., in the formula (I) above, a represents a value of 5 to 10 and b represents a value of 5 to 10, and $R^1$ and $R^2$ each independently represents a methyl group, weight average molecular weight: 1,000) are added to the dispersion, and the resultant solution is stirred for 60 minutes.

Next, solid-liquid separation is performed by centrifugation, the supernatant liquid is eliminated, and extra polyallylamine is removed. A cycle of addition of ion exchanged water, stirring for 10 minutes, and centrifugation is repeated until the conductivity of the washing solution becomes 20 μS/cm or less. The particles are filtered using filter paper (No4A, manufactured by Advantech Co., Ltd.), washed with ion exchange water, dried at 35° C. for 24 hours (moisture content: 0.5% by weight), and then crushed, thereby obtaining toner particles whose volume average particle diameter is 3.4 μm. The amount of sodium ions of the toner particles is 0.036 mg with respect to 1 g of the toner particles.

Preparation of Developer 30 parts by weight of the obtained toner particles whose surface is modified are mixed with 70 parts by weight of silicone oil (KF96-20CS, manufactured by Shin-Etsu Chemical Co., Ltd.) and the liquid developer having a solid content concentration of 30% by weight is prepared. Evaluations are performed in the same manner as in Example 1. The evaluation results are shown in Table 1.

Example 3

Preparation of Liquid Developer 20 parts by weight of a magenta pigment (C. I. Pigment Red 122, manufactured by Clariant, Ltd.) and 20 parts by weight of C. I. Pigment Red 57:1 (manufactured by Dainichiseika Color & Chemicals Mfg. Co., Ltd.) are added to 60 parts by weight of the amorphous polyester resin (1), and the mixture is kneaded by a pressure kneader. The kneaded material is coarsely pulverized and a magenta pigment masterbatch is prepared. Next, a mixture having the following composition is put into a sealed reaction container in which a dissolver is installed and is dissolved and dispersed for 1 hour while refluxing at a temperature of 80° C.

The above-described magenta pigment masterbatch: 25 parts by weight

Amorphous polyester resin (2): 55 parts by weight

Crystalline polyester resin (1): 10 parts by weight

Methyl ethyl ketone: 100 parts by weight

The temperature of the dispersion is cooled to 25° C., 8.0 parts by weight of a 10 wt % sodium hydroxide aqueous solution are slowly added thereto, and the solution is kept at a temperature of 25° C. and stirred at 4,000 rpm. 200 parts by weight of ion exchange water are slowly added dropwise thereto, and phase inversion emulsification is performed. Next, 0.25 parts by weight of a surfactant (manufactured by Kao Corporation, PELEX CS) are added, the stirring rotation speed is dropped to 500 rpm, 38 parts by weight of a 5 wt % sodium sulfate aqueous solution are slowly added dropwise, and particles are coalesced. Further, the particles are stabilized by adding 200 parts by weight of ion exchange water. While the container is warmed, the pressure inside of the reaction container is reduced by a vacuum pump to remove methyl ethyl ketone. After the reaction solution is cooled, the particles are separated by centrifugation and washed with ion exchange water. 100 parts by weight of washed toner particles are re-dispersed using a homogenizer by adding ion exchange water such that the solid content concentration thereof becomes 15% by weight. The pH thereof is adjusted to 1.5 by adding 1 N of hydrochloric acid to the dispersion, the solution is stirred for 3 hours, solid-liquid separation is performed by centrifugation, the supernatant liquid is eliminated, and extra acids are removed. Subsequently, 900 parts by weight of ion exchange water are added thereto for re-dispersion, a 4.0 parts by weight of polyethyleneimine aqueous solution (manufactured by JUNSEI CHEMICAL CO., LTD., weight average molecular weight: 70,000, solid content concentration: 30% by weight) are added thereto, and the mixture is stirred using a propeller type stirrer for 1 hour. Next, toner particles are separated by centrifugation, washed with ion exchange water, dried in a vacuum at 40° C., and toner particles having a volume average particle diameter of 2.5 μm are obtained. The amount of sodium ions of toner particles is 0.024 mg with respect to 1 g of the toner particles.

Preparation of Developer 30 parts by weight of the obtained toner particles whose surface is modified are mixed with 70 parts by weight of silicone oil (KF96-20CS, manufactured by Shin-Etsu Chemical Co., Ltd.) and 0.1 parts by weight of carboxy-modified silicone oil (X-22-3701E: manufactured by Shin-Etsu Chemical Co., Ltd., in the formula (II) above, X and Y each independently represent a hydrogen atom, Z represents COOH, $R^3$ and $R^4$ each independently represent a methylene group, and $R^5$ represents an alkylene group (details unknown), number average molecular weight: 40,000) (compound (II-1)) are mixed with each other and thus a liquid developer having a solid content concentration of 30% by weight is prepared. Evaluations are performed as in Example 1. The evaluation results are shown in Table 1.

(II-1)

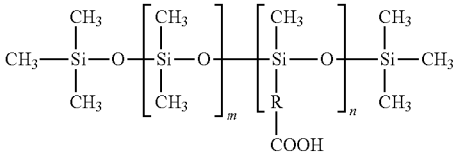

Example 4

Preparation of Dispersion of Crystalline Polyester Resin Particles 160 parts by weight of the crystalline polyester resin (1), 233 parts by weight of ethyl acetate, and 0.1 parts by weight of sodium hydroxide aqueous solution (0.3 N) are prepared, put into a separable flask, heated at 75° C., and stirred using a three-one motor (manufactured by Shinto Scientific Co., Ltd.), thereby preparing a resin mixed liquid. The resin mixed liquid is further stirred, 373 parts by weight of ion exchange water is slowly added, phase inversion emulsification is performed, the temperature is decreased to 40° C. at a temperature dropping rate of 10° C./min, and the solvent is removed thereby obtaining a dispersion of crystalline polyester resin particles (solid content concentration: 30% by weight).

Preparation of Dispersion of Amorphous Polyester Resin Particles 160 parts by weight of the amorphous polyester resin (1), 233 parts by weight of ethyl acetate, and 0.1 parts by weight of sodium hydroxide aqueous solution (0.3 N) are prepared, put into a separable flask, heated at 70° C., and stirred using a three-one motor (manufactured by Shinto Scientific Co., Ltd.), thereby preparing a resin mixed liquid. The resin mixed liquid is further stirred, 373 parts by weight of ion exchange water is slowly added, phase inversion emulsification is performed, the temperature is decreased to 40° C. at a temperature dropping rate of 1° C./min, and the solvent is removed thereby obtaining a dispersion of amorphous polyester resin particles (solid content concentration: 30% by weight).

Preparation of Colorant Dispersion

Cyan pigment (C. I. Pigment blue 15:3, manufactured by Dainichiseika Color & Chemicals Mfg. Co., Ltd.): 45 parts by weight Ioninc surfactant (NEOGEN RK, manufactured by Daiichi Kogyo Seiyaku Co., Ltd.): 5 parts by weight Ion exchange water: 200 parts by weight The above-described components are mixed, dissolved, and dispersed using a homogenizer (manufactured by IKA, ULTRA-TURRAX T50) for 10 minutes, thereby obtaining a colorant dispersion having a volume average particle diameter of 170 nm.

Preparation of Release Agent Dispersion

Paraffin wax (melting temperature: 69° C., manufactured by Wako Pure Chemical Industries, Ltd.): 45 parts by weight Cationic surfactant (NEOGEN RK, manufactured by Daiichi Kogyo Seiyaku Co., Ltd.): 5 parts by weight Ion exchange water: 200 parts by weight The above-described components are heated at 90° C., sufficiently dispersed using a homogenizer (manufactured by IKA, ULTRA-TURRAX T-50), and subjected to a dispersion treatment using a pressure discharge type Gaulin homogenizer, thereby obtaining a release agent dispersion having a volume average particle diameter of 200 nm and a solid content of 24.3% by weight.

Preparation of Liquid Developer

Dispersion of crystalline polyester resin particles: 15 parts by weight

Dispersion of amorphous polyester resin particles: 80 parts by weight

Colorant dispersion: 18 parts by weight

Release agent dispersion: 18 parts by weight

Ion exchange water is added to the above-described components such that the solid content becomes 16% by weight, and the mixture is sufficiently mixed in a round stainless steel flask with an ULTRA-TURRAX T50 and dispersed. Next, 0.36 parts by weight of polyaluminum chloride are added thereto, and a dispersion operation is continued by the ULTRA-TURRAX T50. The flask is stirred with an oil bath for heating and heated to 47° C. The flask is kept at 47° C. for 60 minutes, the pH in the system is adjusted to 9.0 using a 0.55 mole/L sodium hydroxide aqueous solution, the stainless steel flask is sealed, stirring is continued using a magnetic seal, the temperature is increased to 90° C., and then the flask is kept for 3.5 hours. When the particle diameter is measured at this time, the volume average particle diameter is 2.3 the volume average particle size distribution index GSDv is 1.24, and the number average particle size distribution index GSDp is 1.30. After the above-described treatment is completed, the solution is cooled, filtered, and sufficiently washed with ion exchange water, and solid-liquid separation is performed by Nutsche suction filtration. The resultant is re-dispersed using 3,000 parts by weight of ion exchange water at 25° C., stirred at 300 rpm for 15 minutes, and then washed. This operation is repeatedly performed 5 times and when the electric conductivity of the filtrate becomes 10 μS/cm, solid-liquid separation is performed by Nutsche suction filtration using filter paper No4A, thereby obtaining toner particles.

Surface Modification of Toner Particles 900 parts by weight of ion exchange water are added to 100 parts by weight of the obtained toner particles to prepare a dispersion of toner particles (solid content concentration: 15% by weight). The pH thereof is adjusted to 1.5 by adding 1 N of nitric acid to the dispersion, the solution is stirred for 10 minutes in ultrasonic waves, solid-liquid separation is performed by centrifugation, the supernatant liquid is eliminated, and extra acids are removed. Subsequently, 900 parts by weight of ion exchange water are added thereto for re-dispersion, 5 parts by weight of polyethyleneimine (manufactured by JUNSEI CHEMICAL CO., LTD., weight average molecular weight: 70,000, solid content concentration: 30% by weight) are added to the dispersion, and the solution is stirred for 60 minutes. Next, solid-liquid separation is performed by centrifugation, the supernatant liquid is eliminated, and extra polyethyleneimine is removed. A cycle of addition of ion exchanged water, stirring for 10 minutes, and centrifugation is repeated until the conductivity of the washing solution becomes 20 μS/cm or less. The particles are filtered using filter paper (No4A, manufactured by Advantech Co., Ltd.), washed with ion exchange water, dried at 35° C. for 24 hours (moisture content: 0.5% by weight), and then crushed, thereby obtaining toner particles whose volume average particle diameter is 2.4 μm. The amount of sodium ions of the toner particles is 0.028 mg with respect to 1 g of the toner particles.

Preparation of Developer 30 parts by weight of the obtained toner particles whose surface is modified are mixed with 70 parts by weight of silicone oil (KF96-20CS, manufactured by Shin-Etsu Chemical Co., Ltd.) and 0.05 parts by weight of carboxy-modified silicone oil (X-22-162C: manufactured by Shin-Etsu Chemical Co., Ltd., in the formula (II) above, X and Y each independently represent COOH, Z represents a hydrogen atom, $R^3$ and $R^4$ each independently represent an alkylene group (details unknown), and $R^5$ represents a methylene group, number average molecular weight: 4,600) (compound (II-2)) and then a liquid developer in which toner particles are dispersed is obtained. Evaluations are performed as in Example 1. The evaluation results are shown in Table 1.

(II-2)

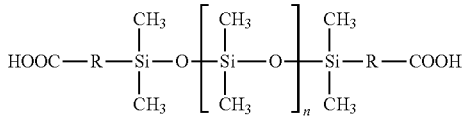

Example 5

Preparation of Liquid Developer

Dispersion of crystalline polyester resin particles: 5 parts by weight

Dispersion of amorphous polyester resin particles: 90 parts by weight

Colorant dispersion: 18 parts by weight

Release agent dispersion: 18 parts by weight

Ion exchange water is added to the above-described components such that the solid content becomes 16% by weight, and the mixture is sufficiently mixed in a round stainless steel flask with an ULTRA-TURRAX T50 and dispersed. Next, 0.36 parts by weight of polyaluminum chloride are added thereto, and a dispersion operation is continued by the ULTRA-TURRAX T50. The flask is stirred with an oil bath for heating and heated to 47° C. The flask is kept at 47° C. for 60 minutes and 46 parts by weight of an amorphous polyester resin particle dispersion is slowly added thereto. Subsequently, the pH in the system is adjusted to 9.0 using a 0.55 mole/L sodium hydroxide aqueous solution, the stainless steel flask is sealed, stirring is continued using a magnetic seal, the temperature is increased to 90° C., and then the flask is kept for 3.5 hours. When the particle diameter is measured at this time, the volume average particle diameter is 2.3 μm, the volume average particle size distribution index GSDv is 1.24, and the number average particle size distribution index GSDp is 1.30. After the above-described treatment is completed, the solution is cooled, filtered, and sufficiently washed with ion exchange water, and solid-liquid separation is performed by Nutsche suction filtration. The resultant is re-dispersed using 3,000 parts by weight of ion exchange water at 40° C., stirred at 300 rpm for 15 minutes, and then washed. This operation is repeatedly performed 5 times and when the electric conductivity of the filtrate becomes 5 μS/cm, solid-liquid separation is performed by Nutsche suction filtration using filter paper No4A, thereby obtaining toner particles.

Surface Modification of Toner Particles 900 parts by weight of ion exchange water are added to 100 parts by weight of the obtained toner particles to prepare a dispersion of toner particles (solid content concentration: 15% by weight). The pH thereof is adjusted to 1.5 by adding 1 N of nitric acid to the dispersion, the solution is stirred for 10 minutes in ultrasonic waves, solid-liquid separation is performed by centrifugation, the supernatant liquid is eliminated, and extra acids are removed. Subsequently, 900 parts by weight of ion exchange water are added thereto for redispersion, 5 parts by weight of polyethyleneimine (manufactured by JUNSEI CHEMICAL CO., LTD., weight average molecular weight: 70,000, solid content concentration: 30% by weight) are added to the dispersion, and the solution is stirred for 60 minutes. Next, solid-liquid separation is performed by centrifugation, the supernatant liquid is eliminated, and extra polyethyleneimine is removed. A cycle of addition of ion exchanged water, stirring at 40° C. for 60 minutes, and centrifugation is repeated until the conductivity of the washing solution becomes 5 μS/cm or less. The particles are filtered using filter paper (No4A, manufactured by Advantech Co., Ltd.), washed with ion exchange water, dried at 35° C. for 24 hours (moisture content: 0.5% by weight), and then crushed, thereby obtaining toner particles whose volume average particle diameter is 2.5 The amount of sodium ions of the toner particles is 0.011 mg with respect to 1 g of the toner particles. Since the amount of sodium ions in a blank which does not contain the toner particles is 0.010 mg, this numeric value is close to the measurement limit.

Preparation of Developer 30 parts by weight of the obtained toner particles whose surface is modified are mixed with 70 parts by weight of dimethyl silicone oil (20cs, manufactured by Shin-Etsu Silicone Co., Ltd.) to thereby obtain a liquid developer in which toner particles are dispersed. Evaluations are performed as in Example 1. The evaluation results are shown in Table 1.

Comparative Example 1

A liquid developer is prepared by performing the same treatment as in Example 1 except that the addition of 1 N of hydrochloric acid and all the subsequent processes in Example 1 are omitted. Evaluations are performed in the same manner as in Example 1. The evaluation results are shown in Table 1.

Comparative Example 2

A liquid developer is prepared by performing the same treatment as in Example 2 except that only the process of adding 1 N of hydrochloric acid to adjust the pH value thereof to 1.5 in Example 2 is omitted. Evaluations are performed in the same manner as in Example 1. The evaluation results are shown in Table 1.

Comparative Example 3

A liquid developer is prepared by performing the same treatment as in Example 3 except that 1N of hydrochloric acid is added and the pH thereof is adjusted to 6.0 instead of 1.5 in Example 3. Evaluations are performed in the same manner as in Example 1. The evaluation results are shown in Table 1.

Comparative Example 4

A liquid developer is prepared by performing the same treatment as in Example 3 except that only the process of adding 1N of hydrochloric acid to adjust the pH value thereof to 1.5 in Example 3 is omitted. Evaluations are performed in the same manner as in Example 1. The evaluation results are shown in Table 1.

Comparative Example 5

A liquid developer is prepared by performing the same treatment as in Example 3 except that 1N of hydrochloric acid is added and the pH thereof is adjusted to 3.0 instead of 1.5 in Example 3. Evaluations are performed in the same manner as in Example 1. The evaluation results are shown in Table 1.

Comparative Example 6

A liquid developer is prepared by performing the same treatment as in Example 3 except that 1N of hydrochloric acid is added and the pH thereof is adjusted to 2.0 instead of 1.5 in Example 3. Evaluations are performed in the same manner as in Example 1. The evaluation results are shown in Table 1.

As shown above, positive charging properties are excellent in Examples in which the amount of sodium ions to be eluted in 1 g of the toner particles is 0.04 mg or less in the liquid developer containing toner particles whose surface is treated by a polyamine, compared to those in Comparative Examples.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A liquid developer comprising:

a carrier liquid; and toner particles, each of whose surfaces is treated by a polyamine and contains sodium ions, wherein an amount of sodium ions to be eluted in 1 g of the toner particles in the liquid developer is 0.04 mg or less.

2. The liquid developer according to claim 1, wherein the polyamine is a polyalkyleneimine.

3. The liquid developer according to claim 1, wherein the polyamine is a polyallylamine represented by the formula (I):

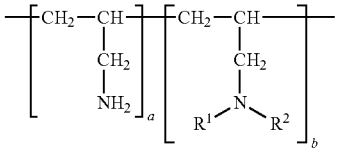

(I)

wherein $R^1$ and $R^2$ each independently represent a hydrogen atom or an aliphatic hydrocarbon group having 1 to 20 carbon atoms, and a and b each independently represent an integer of 100 to 1,000.

4. The liquid developer according to claim 1, wherein the carrier liquid contains a carboxyl group-containing silicone.

TABLE 1

| | Treatment agent of toner particles | Additive | Amount of sodium ions per 1 g of toner particles (mg) | Charging polarity | Charging strength |
|---|---|---|---|---|---|
| Example 1 | Polyethyleneimine | — | 0.038 | + | B |
| Example 2 | Polyarylamine PAA-1112 | — | 0.036 | + | B |
| Example 3 | Polyethyleneimine | Compound (II-1) | 0.024 | + | A |
| Example 4 | Polyethyleneimine | Compound (II-2) | 0.028 | + | A |
| Example 5 | Polyethyleneimine | — | 0.011 | + | A |
| Comparative Example 1 | — | — | 0.052 | ± | E |
| Comparative Example 2 | Polyarylamine PAA-1112 | — | 0.050 | + | D |
| Comparative Example 3 | Polyethyleneimine | Compound (II-1) | 0.044 | + | C |
| Comparative Example 4 | Polyethyleneimine | Compound (II-1) | 0.048 | + | C |
| Comparative Example 5 | Polyethyleneimine | Compound (II-1) | 0.044 | + | C |
| Comparative Example 6 | Polyethyleneimine | Compound (II-1) | 0.042 | + | C |

5. The liquid developer according to claim 4, wherein the carboxyl group-containing silicone is a compound represented by the formula (II):

(II)

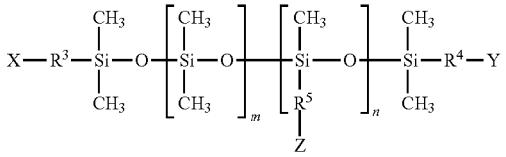

wherein X, Y, and Z each independently represent a hydrogen atom or a carboxyl group; at least one of X, Y, and Z represents a carboxyl group; m represents an integer of 1 to 1,000; n represents an integer of 1 to 10; and $R^3$, $R^4$, and $R^5$ each independently represent a single bond or a divalent aliphatic hydrocarbon group having 1 to 20 carbon atoms.

6. The liquid developer according to claim 1, wherein a content of the polyamine is in a range of from 0.1 parts by weight to 100 parts by weight with respect to 100 parts by weight of the toner particles.

7. The liquid developer according to claim 1, wherein the amount of sodium ions to be eluted in from 1 g of the toner particles is 0.03 mg or less.

8. A developer cartridge which is detachable from an image forming apparatus, comprising a container containing the liquid developer according to claim 1.

9. The developer cartridge according to claim 8, wherein the polyamine of the liquid developer is polyalkyleneimine.

10. The developer cartridge according to claim 8, wherein the polyamine of the liquid developer is a polyallylamine represented by the formula (I):

(I)

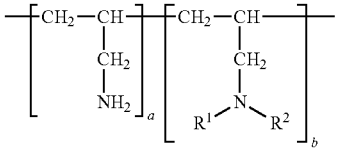

wherein $R^1$ and $R^2$ each independently represent a hydrogen atom or an aliphatic hydrocarbon group having 1 to 20 carbon atoms, and a and b each independently represent an integer of 100 to 1,000.

11. The developer cartridge according to claim 8, wherein the carrier liquid of the liquid developer contains a carboxyl group-containing silicone.

12. The developer cartridge according to claim 11, wherein the carboxyl group-containing silicone is a compound represented by the formula (II):

(II)

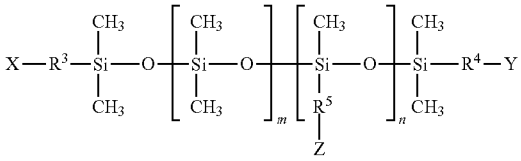

wherein X, Y, and Z each independently represent a hydrogen atom or a carboxyl group; at least one of X, Y, and Z represents a carboxyl group; m represents an integer of 1 to 1,000; n represents an integer of 1 to 10; and $R^3$, $R^4$, and $R^5$ each independently represent a single bond or a divalent aliphatic hydrocarbon group having 1 to 20 carbon atoms.

* * * * *